United States Patent [19]

Willer et al.

[11] Patent Number: 4,889,571

[45] Date of Patent: Dec. 26, 1989

[54] HIGH-ENERGY COMPOSITIONS HAVING CASTABLE THERMOPLASTIC BINDERS

[75] Inventors: Rodney L. Willer, New London, Pa.; James A. Hartwell, Elkton, Md.; Robert G. Gleeson, Newark, Del.

[73] Assignee: Morton Thiokol, Inc., Chicago, Ill.

[21] Appl. No.: 903,000

[22] Filed: Sep. 2, 1986

[51] Int. Cl.[4] ..... C06B 45/10

[52] U.S. Cl. ..... 149/19.9; 149/19.92; 264/3.1

[58] Field of Search ..... 149/19.9, 19.92; 264/3.1

[56] References Cited

U.S. PATENT DOCUMENTS

| | | | |
|---|---|---|---|
| 3,449,179 | 6/1969 | Minekawa et al. | 149/19.9 |
| 3,501,357 | 3/1970 | Suzuki et al. | 149/19.9 |
| 3,779,825 | 12/1973 | Blackwell | 149/19.9 |
| 3,888,707 | 6/1975 | Rothenstein | 149/19.91 |
| 4,361,526 | 11/1982 | Allen | 264/3 |
| 4,597,924 | 7/1986 | Allen et al. | 149/19.91 |

OTHER PUBLICATIONS

Allen et al., "Thermoplastic Composite Propellant Development", 6 pages, U.S. Army Missile Cmd., Redstone Arsenal (Mar. 1985).

*Primary Examiner*—Edward A. Miller

*Attorney, Agent, or Firm*—Wayne E. Nacker; Gerald K. White

[57] ABSTRACT

A propellant formulation includes energetic particulate solids dispersed in a binder system of high molecular weight 1,2 syndiotactic butadiene and a plasticizer. The propellant is prepared by mixing above the melting temperature of the butadiene and without the use of solvents. The propellant is castable without curing.

14 Claims, No Drawings

HIGH-ENERGY COMPOSITIONS HAVING CASTABLE THERMOPLASTIC BINDERS

The present invention is directed to castable thermoplastic binders for high-energy compositions, particularly composite solid rocket propellants.

BACKGROUND OF THE INVENTION

Conventional solid composite propellants utilize chemically cross-linked elastomers in which prepolymers are cross-linked by chemical curing agents. As outlined in detail in U.S. Pat. No. 4,361,526, there are important disadvantages to cross-linked elastomers. Cross-linked elastomers must be cast within a short period of time after addition of the curative, which time period is known as the "pot life". Disposal of a cast cross-linked propellant composition is difficult except by burning which poses environmental problems.

As an alternative to cross-linked binders, U.S. Pat. No. 4,361,526 proposes to use a thermoplastic elastomeric binder which is a block copolymer of a diene and styrene, the styrene blocks providing a meltable crystal structure and the diene blocks imparting rubbery or elastomeric properties to the copolymer. In order to prepare a propellant composition using the copolymer, the copolymer is dissolved in an organic solvent, such as toluene, and the solids and other propellant formulations are added. The solvent is then evaporated, leaving a rubbery solid which may be divided into pellets suitable for casting or other processing.

A disadvantage of formulating a propellant composition using a thermoplastic elastomeric binder which must be dissolved in a solvent is that the propellant formulation cannot be cast in a conventional manner, e.g., into a rocket motor casing. Furthermore, solvent-based processing presents problems with respect to solvent removal and recovery. Organic solvents, such as toluene, present certain hazards both to the immediate work area and to the larger environment, necessitating various precautions to be taken with respect to processing such propellant formulations.

It would be desirable to have propellants and other high-energy solid compositions which include thermoplastic elastomeric binders which can be melted and cast without the need for solvent processing.

SUMMARY OF THE INVENTION

In accordance with the invention, a propellant binder system comprises a high molecular weight syndiotactic 1,2-polybutadiene binder plus a suitable plasticizer. The polybutadiene binder system is useful for spatially immobilizing solid particulates, such as fuel material particulates and oxidizer particulates, in a propellant formulation. The polybutadiene binder is meltable, allowing it to be mixed with other components of the propellant formulation, including the solid particulates and the plasticizer, and is castable, e.g., into a rocket motor shell. No organic solvent is required to prepare or cast the propellant formulation.

DETAILED DESCRIPTION OF CERTAIN PREFERRED EMBODIMENTS

High molecular weight syndiotactic 1,2-polybutadiene in combination with a suitable plasticizer, is found to provide a suitable elastomeric binder system for solid propellant compositions or the like. The polymer is a thermoplastic elastomer which melts in the temperature range of from about 70° C. to about 100° C. and therefore can be melted in the presence of fuel particulates and oxidizers to form a solvent-free propellant formulation melt. The melt is directly castable as a propellant charge into a rocket motor casing or the like.

Polybutadienes in accordance with the present invention have weight average molecular weight of between about 100,000 and about 200,000. The crystallinities range from between about 10 percent and about 35 percent and preferably between about 15 and about 30%. Densities range from about 0.90 to about 0.91. By 1,2 butadiene is meant that substantially all, i.e., greater than about 90% of monomer addition is by 1,2 polymerization. By syndiotactic is meant that at least about 90% of the 1,2 additions result in the pendant vinyl group extending from the side opposite that of the two flanking pendant vinyl groups. Syndiotactic 1,2-polybutadiene polymers suitable for use as binders are sold, for example, by the Japanese Synthetic Rubber Company under the trade designations JSR RB-810, JSR RB-820 and JSR RB-830.

Polybutadienes used in accordance with the present invention have thermal properties which make them especially suitable as propellant binders, the range from the brittle point (glass transition temperature ($T_g$)) to the softening point generally encompassing the ordinary ambient temperature range. Viscat softening points of these compounds range from about 35° C. to about 70° C.; melting points range from about 70° C. to about 100° C. and brittle points range from about −35° C. to about −40° C. Thus while the thermoplastics are elastomers at ambient temperatures, they can be processed as molten plastics at temperatures far below the temperatures where high-energy solids become unstable. The low processing temperatures of 1,2 syndiotactic butadienes is considered an important advantage relative to other thermoplastic elastomers which have been considered for use as propellant binders.

The polybutadienes have good tensile properties for binders 300% moduli range from about 40 to about 80 kg/cm$^2$; Tensile strengths range from about 60 to about 140 kg/cm$^2$ and elongation ranges from about 650 to about 800 %. Shore D hardnesses range from about 30 to about 50.

To provide the polymer with suitable elastomeric properties to serve as a binder, the complete binder system includes a plasticizer with which the polymer is miscible. Suitable plasticizers include dioctyl adipate (DOA) and dioctyl phthalate (DOP); however, other miscible plasticizers known in the art are also suitable. Mixtures of plasticizers, such as DOA/DOP mixtures are also suitable. Particularly suitable plasticizers are naphthenic oils, such as those sold under the trademark Tufflo by Arco, particularly Tufflo-500. The plasticizer comprises between about 50 and about 75 percent by weight of the binder system (binder plus plasticizer) and preferably between about 50 and about 67 percent by weight.

The binder system may also include a minor amount of a wetting agent or lubricant, such as lecithin. The wetting agent or lubricant enables a higher solids loading. The lubricant typically comprises up to about 4 weight percent of the total weight of the polybutadiene plus plasticizer. A presently preferred lubricant is a coating agent sold under the trade designation FC-430 by 3M.

A complete propellant formulation includes a high percentage of energetic solid particulates, including fuel material particulates, such as aluminum, and oxidizer particulates, such as ammonium perchlorate (AP), cyclotetramethylene tetranitramine (HMX) and cyclotrimethylene trinitramine (RDX), the solid particulates typically comprising between about 70 and about 90 wt. percent of the propellant composition and the balance being substantially all binder system. In addition, the propellant may include minor amounts of additional components, such as a bonding agent and burn rate modifiers.

Because the thermoplastic elastomer does not have a "pot life" in the sense of cross-linked elastomers, the order of mixing propellant formulation ingredients is not considered to be critical. However, for ease of mixing, it is generally preferred that the binder system, including the binder, plasticizer, and any lubricant, be blended under binder melting conditions prior to adding the solids. After the binder system is melted and blended, the solids are added, and mixing is continued to provide a uniform dispersion of solids in binder system. To provide a uniform cast, it is preferred to deaerate the molten formulation and then to cast the melt.

Cast propellant may be remelted after solidifying. Thus, there is no need to cast the propellant immediately after mixing, although from an energy efficiency standpoint this is generally desirable.

An important advantage of having a propellant which is meltable is that the propellant from an outdated missile can be melted down and reused. At the time of such remelting, the propellant might be reformulated, e g., by addition of additional fuel or oxidizer particulates. Accordingly, the thermoplastic of the propellant composition provides for its eventual recycle, as opposed to the burning required for disposal of thermoset propellant compositions. Because the thermoplastic propellant does not have a "pot life", there are no limitations to the time of casting, and if any problems develop during casting, the process can be delayed as long as necessary merely by maintaining the propellant formulation in molten form.

In preparing propellants in accordance with the present invention, no solvents or other highly volatile substances are required. Accordingly, no special measures or special apparatus are required to contain solvent vapors, to remove solvent from the formulation or to recover solvent for reuse. Propellant formulations in accordance with the present invention may be prepared by conventional mixing apparatus without requiring extrusion, although extrusion may be used to prepare certain forms of propellants, such as propellant pellets.

An important advantage of syndiotactic butadienes for use in propellant binders is their low melting temperatures, and propellant formulations using syndiotactic butadienes are processable in the range of to 120° C. Low processing temperatures help to ensure safety in processing high-energy compounds. Syndiotactic butadienes also have excellent low-temperature properties, typically having glass transition temperatures in the range of −40° F. (−40° C.). Low-temperature properties are important for propellant systems which might be used at very low temperatures or even exposed to very low temperatures prior to use.

The invention will now be described in greater detail by way of specific examples.

EXAMPLE 1

A pilot scale mix of a composite propellant with a thermoplastic elastomeric binder is described in this example. 240 grams of a composite propellant were made from the following ingredients:

| Ingredient | Weight Percent |
|---|---|
| Syndiotactic Polybutadiene RB-810 | 8.3 |
| Dioctyl Adipate | 15.9 |
| Lecithin | 0.8 |
| Unground Ammonium Perchlorate (AP) 200 u | 50.0 |
| Ground Ammonium Perchlorate (AP) 18 u | 25.0 |

The ingredients were mixed in a Baker Perkins twin blade vertical mixer with a working capacity of approximately 0.5 liters. First the polybutadiene, dioctyl adipate, and lecithin were added to the mix bowl and mixed for a total of 70 minutes with stops after 10, 20, 40 and 60 minutes for scrape down of the mixer blades. A water/ethylene glycol mixture at 210° F. was circulated through the mixer jacket in order to heat the mixture. After 70 minutes of mix time, the mix temperature had climbed to 160° F. and the polybutadiene was partially melted. At this point, one half of the unground AP was added to the mix bowl and mixed for 20 minutes. After 130 minutes total of mix time, the mixing was complete and the batch was uniform in appearance. The mix temperature was 177° F. and its viscosity was 8 Kp. The mix was then deaerated and cast into a rectangular mold by letting it drop through a funnel an slit plate into a vacuum bell.

After the mold had cooled, the propellant was removed from it and cut into ¼" diameter by 4" long cylindrical stands for testing of burn rate. Four strands were prepared and inhibited on all but one circular face with black enamel paint. These strands were then burned in a pressurized bomb to determine propellant burn rate. Two strands were burned at an average pressure of 1015 psig and had an average burn rate of 0.247 in/sec. The other two were burned at a pressure of 510 psig and had an average burn rate of 0.183 in/sec.

EXAMPLE 2

Nine more pilot scale batches of composite propellants using the thermoplastic elastomer binder were made and cast substantially the same manner as described in Example 1. The level of AP oxidizer was varied from 75% to 85% of the total mixture by weight. Both RB-810 and RB-820 grades of JSR syndiotactic polybutadiene were used and plasticizer to polymer ratio was varied between 2 to 1 and 1 to 1. The table below indicates the batch numbers, formulation and processing results for these batches. JANNAF Class C uniaxial tensiles were prepared from the finished batches and tested at a constant strain rate of 2.0 in/min at a temperature of 77° F. Maximum stress, strain at maximum stress and elastic modulus were calculated from these tests and are presented in the table.

| Batch Number | 725 | 726 | 736 | 737 | 738 | 741 | 742 | 743 | 744 |
|---|---|---|---|---|---|---|---|---|---|
| TPE Type* | 810 | 810 | 810 | 810 | 810 | 810 | 810 | 820 | 820 |
| Bonding Agent Type** | HX-752 | — | — | — | KR | KR | KR | KR | KR |
| Weight Percent | | | | | | | | | |

-continued

| Batch Number | 725 | 726 | 736 | 737 | 738 | 741 | 742 | 743 | 744 |
|---|---|---|---|---|---|---|---|---|---|
| TPE | 8.3 | 8.3 | 6.7 | 8.0 | 6.5 | 7.3 | 4.9 | 4.9 | 4.9 |
| Dioctyl adipate | 15.8 | 16.7 | 13.3 | 12.0 | 13.1 | 7.3 | 9.7 | 9.7 | 9.7 |
| Bonding Agent | 0.4 | — | — | — | 0.4 | 0.4 | 0.4 | 0.4 | 0.4 |
| AP, unground (200 u) | 50.0 | 50.0 | 53.3 | 53.3 | 53.3 | 56.7 | 56.7 | 56.7 | 56.7 |
| AP, ground (18 u) | 25.0 | 25.0 | 26.7 | 26.7 | 26.7 | 28.3 | 28.3 | 28.3 | 28.3 |
| Processing Results | | | | | | | | | |
| End of mix temp., °F. | — | 172 | 190 | 195 | 196 | 195 | 184 | 186 | 201 |
| End of mix viscosity, Kp | — | 16 | 22 | 40 | 24 | 216 | 60 | 100 | 68 |
| Tensile Results | | | | | | | | | |
| Maximum stress, psi | 13 | 9 | 9 | 12 | 9 | 17 | — | 15 | 15 |
| Strain at max stress, % | 47 | 77 | 55 | 28 | 52 | 13 | — | 21 | 16 |
| Elastic modulus, psi | 97 | 38 | 71 | 112 | 47 | 267 | — | 122 | 166 |

*810 = JSR grade RB-810; 820 = JSR grade RB-820
**HX 742 = oxidizer bonding agent HX-752, 3M Company
KR = Titanate bonding agent KRP 380, Kenrich Chemical While the invention has been described in terms of certain preferred embodiments, modifications, obvious to one with ordinary skill in the art may be made without departing from the scope of the present invention. For example, although the novel binder system according to the present invention has been described primarily in terms of its use in propellants, the binder system is applicable to other solid, high-energy compositions, such as explosives and gasifiers.

Various features of the invention are set forth in the following claims.

What is claimed:

1. A melt-cast propellant composition comprising energetic particulate solids dispersed in and spatially immobilized in a binder system having between about 25 and about 50 weight percent of 1,2 syndiotactic polybutadiene and between about 50 and about 75 weight percent of a plasticizer miscible with said polybutadiene.

2. A composition in accordance with claim 1 comprising between about 70 and about 90% energetic particulate solids, balance said binder system.

3. A composition in accordance with claim 1 wherein said 1,2 syndiotactic polybutadiene has a weight average molecular weight of between about 100,000 and about 200,000.

4. A composition in accordance with claim 1 wherein said plasticizer is selected from the group consisting of dioctyl adipate, dioctyl phthalate and mixtures thereof.

5. A composition according to claim 1 wherein said binder system includes up to about 4 wt. percent of a wetting agent based upon the total weight of plasticizer and polybutadiene in said binder system.

6. A composition according to claim 5 wherein said wetting agent is lecithin.

7. A method of preparing a propellant composition comprising mixing energetic particulate solids with 1,2 syndiotactic polybutadiene plus a plasticizer that is miscible with said polybutadiene at a temperature whereat said polybutadiene is molten, melt-casting said molten mixture into a mold, and allowing said molten mixture to cool to a solid propellant composition with said solid particulates dispersed in plasticized polybutadiene.

8. A method according to claim 7 wherein said molten mixture is deaerated before cooling.

9. A method according to claim 8 wherein said molten mixture is cast after deaeration and prior to cooling.

10. A method according to claim 7 wherein said temperature is at least about 90° C.

11. A method according to claim 7 wherein said plasticizer comprises between about 50 and about,75 wt. percent of the total weight of plasticizer plus polybutadiene.

12. method according to claim 7 wherein a lubricant is provided in said molten butadiene melt at up to about 4 weight percent relative to the total weight of said polybutadiene and said plasticizer.

13. A method according to claim 7 wherein said polybutadiene and said plasticizer are blended at said temperature and then said energetic solids are added.

14. A method of preparing a propellant composition comprising mixing, in the absence of organic solvents, energetic particulate solids with 1,2 syndiotactic polybutadiene plus a plasticizer that is miscible with said polybutadiene at a temperature whereat said polybutadiene is molten, melt-casting said molten mixture into a mold, and allowing said molten mixture to cool to a solid composition with said solid particulates dispersed in plasticized polybutadiene.

* * * * *